United States Patent [19]

Leonard

[11] Patent Number: 4,584,860

[45] Date of Patent: Apr. 29, 1986

[54] TOOLING SYSTEM FOR SUPERPLASTIC FORMING OF METALS

[75] Inventor: Kirke Leonard, Redondo Beach, Calif.

[73] Assignee: Rockwell International Corporation, El Segundo, Calif.

[21] Appl. No.: 745,768

[22] Filed: Jun. 17, 1985

[51] Int. Cl.[4] ..... B21D 22/20

[52] U.S. Cl. ..... 72/61; 72/342; 72/364

[58] Field of Search ..... 72/60, 61, 63, 342, 72/364

[56] References Cited

U.S. PATENT DOCUMENTS

| | | | |
|---|---|---|---|
| 4,087,037 | 5/1978 | Schier | 72/63 |
| 4,188,811 | 2/1980 | Brimm | 72/63 |
| 4,381,657 | 5/1983 | Hamilton | 72/364 |
| 4,474,044 | 10/1984 | Leistner | 72/342 |
| 4,489,579 | 12/1984 | Daime | 72/342 |

*Primary Examiner*—Leon Gilden

*Attorney, Agent, or Firm*—Charles T. Silberberg; Chris Papageorge

[57] ABSTRACT

An oblate spheroid shaped shell has upper and lower component parts which are held together by means of spring loaded clamps. The upper and lower component parts each contain liquid hardenable ceramic material forming die member halves which have surfaces defining a die cavity for superplastic forming of a metal workpiece therein. The ceramic material has electrical heating elements embedded therein and positioned close to the die cavity in order to heat the metal workpiece in the cavity. Tubes in the upper and lower halves of the shell supply pressurized gas and quenching fluid to the die cavity for superplastic forming and quenching of the metal workpiece.

20 Claims, 3 Drawing Figures

TOOLING SYSTEM FOR SUPERPLASTIC FORMING OF METALS

BACKGROUND OF THE INVENTION

This invention relates to a novel apparatus for superplastic forming of metals and more particularly to a relatively safe, stand alone apparatus for superplastic forming.

Superplastic metals are known in the art as materials that provide the strength of conventional metals and the elongation and formability characteristics of conventional plastic materials. Within a limited range of temperatures, certain metals such as titanium and certain aluminum alloys exhibit low resistance to deformation and may be elongated with controlled thinning. This characteristic of such metals occurs at certain strain rates within particular temperature ranges for the metals and is known as superplasticity. Typically, pressurized gas provides the force required to deform the metals. Details concerning a particular method of superplastic forming are described in U.S. Pat. No. 4,181,000 to Hamilton.

One characteristic of prior art superplastic forming devices is that they require the use of relatively large presses. These presses are large in order to have the capability of containing gas pressures of a high magnitude within the apparatus and assuring proper sealing. Consequently, prior art forming apparatus presses are typically inordinately large and require a power supply capable of producing high pressures and a sophisticated hydraulic system. Thus, prior art systems require excessive energy to operate. Moreover, the requirement that a high power press be used adds considerably to the cost and complexity of superplastic forming apparatuses. An example of a prior art device incorporating a hydraulic piston and cylinder type press is illustrated in U.S. Pat. No. 3,529,458 to Butler. It must be noted that the greater and faster it is desired to deform and elongate the superplastic workpiece in the die chamber the greater the power capability required of the hydraulic piston and cylinder arrangement.

In general, superplastic forming devices require the use of rather large presses as well as other devices and structures. Indeed, since prior art metallic dies dissipate heat quickly, large insulators must be used to prevent the escape of heat from the apparatus which would otherwise detract from the heat available to heat the workpiece. This adds considerable weight and bulk to the apparatus necessitating the use of supporting structures. With the exception of U.S. Pat. No. 3,739,617 to Stejskal disclosing a stand alone vacuum forming device, prior art superplastic forming devices are not stand alone or self-contained. In this regard, it must be pointed out that the Stejskal device uses vacuum forming methods in contrast to high pressure forming methods desired for mass production superplastic forming.

Typically, prior art devices incorporate the use of metallic dies. Metallic dies are used because of their durability and because of their ability to withstand the high compressive forces used in superplastic forming. Examples of such devices are in U.S. Pat. No. 4,087,037 to Schier and U.S. Pat. No. 3,668,917 to Komapsu. However, other materials have also been used in prior art die structures. For example, U.S. Pat. No. 3,529,458 to Butler incorporates a die composed of concrete material. Moreover, U.S. Pat. No. 3,739,617 to Stejskal incorporates a die composed of ceramic material. However, it must be noted that in Stejskal's apparatus, pressures within the apparatus do not exceed atmospheric pressure; therefore, pressures on the ceramic die of Stejskal's apparatus will not exceed pressures on the order of 14.7 pounds per square inch. Thus, the ceramic die structure of Stejskal is not required to withstand high pressure and consequently is not well adapted to very fast superplastic forming processes as is the goal in modern mass production assemblies. Although metallic dies have the capability of withstanding high pressures, their hard surface makes the die difficult to manufacture to close tolerances, especially if the die surface must have ridges or other surface irregularities.

It is desirable that the workpiece be cooled while it is in place in the die cavity and prior to removal therefrom in order to prevent further undesired deformation or distortion of the workpiece while at superplastic temperatures. Some prior art superplastic forming apparatuses merely allow the workpiece to air cool after pressure is lowered and the unit is opened. However, this prior art approach has the disadvantage that it allows the workpiece to deform or distort if pressure is dropped quickly and the unit is opened soon after the superplastic forming operation has taken place. If, instead, the workpiece is allowed to cool while still under pressure within the die, this slow cooling can substantially extend the total time required to form the workpiece. Therefore, in an effort to hasten the superplastic forming process some prior art devices have injected the workpiece with a quenching or cooling fluid prior to removal therefrom and often prior to significant pressure drop. U.S. Pat. No. 3,529,458 to Butler and U.S. Pat. No. 4,299,111 to Fayal are examples of this prior art technique of cooling the workpiece prior to removal from the die. However, in contrast to applicant's invention these systems have not expedited the process of heating the workpiece. U.S. Pat. No. 4,299,111 to Fayal also uses high velocity ejection pins to push the workpiece out of the mold after it has been slightly cooled; the slight cooling eliminates any tight fit between the workpiece and the die cavity. The disadvantage of this prior art system is that it requires precise control and timing of ejection pressure and cooling of the workpiece.

Although prior art devices may incorporate structures providing high gas pressures to the superplastic forming cavity, there are typically no safety features used in conjunction with these high pressure structures. Thus, in the event of excess pressure buildup in the die cavity exceeding the ability of the apparatus to withstand such pressures, serious damage may result to the forming apparatus, proximal structures or people in the vicinity. Prior art devices have not addressed the safety problems innerent in superplastic forming systems.

SUMMARY OF THE INVENTION

It is a principle object of the invention to provide a stand alone superplastic forming apparatus which is capable of containing therein the very high pressures required for superplastic forming of materials.

It is another object of the present invention to provide a superplastic forming apparatus having a safety system for venting excess pressure.

It is another object of the invention to provide a superplastic forming apparatus which is compact.

It is still further object of the present invention to provide a superplastic forming apparatus which is energy efficient.

The system of the present invention is specifically designed to be a compact, inexpensive, superplastic forming apparatus incorporating a quickly, easily and inexpensively formed die. An important feature of the present invention is its safety system providing automatic venting of excess gas pressure buildup within the die cavity.

Generally, the invention comprises a pair of snell members which are designed to be joinable so as to form a single shell having the shape of an oblate spheroid. The shell members are preferably of approximately equal size and each shell member contains a die member therein. Both die members are formed of a liquid hardenable ceramic material which in liquid form may be simply poured into each of the shell members. A suitable plate is immersed in the liquid ceramic material or merely placed against its surface so that the liquid ceramic may harden into the desired shape. Alternatively, the liquid hardenable ceramic may also be appropriately formed into the desired shape and surface structure by the use of suitable cutting or forming tools on the semi-liquid ceramic prior to its fully hardening. It is desirable that the ceramic be able to withstand the high compressive forces and the high temperatures of superplastic forming processes. Thus, it is apparent that the use of such a ceramic material rather than a metal enables the die to be made quickly and inexpensively. In contrast, metal dies must be very carefully made using very hard cutting tools. Such metal dies must often be annealed and/or heat treated in order to provide a hard surface able to withstand the high pressures and temperatures of the superplastic forming operation.

It is also pertinent to note that use of liquid hardenable ceramic advantageously allows the heating elements to be easily positioned in the die before hardening. Alternatively, appropriately positioned tubing may also be easily placed in the liquid die material. After hardening of the ceramic, the tubing is burned out or otherwise eliminated from the die member thereby leaving passageways in which the heating elements are inserted. The heating elements should be positioned close to the die surface to transmit heat more effectively to the workpiece. Thus, it is apparent that use of ceramic material eliminates the requirement of drilling holes in a metallic die or of positioning the heating elements underneath the die member or under an upper layer of the die member. A further advantage of the ceramic material is that it dissipates heat very poorly allowing the heating elements to concentrate the heat in the die surface area. The workpiece thus is heated more quickly to superplastic forming temperature and less heat energy is wasted in heating the apparatus surrounding the die surface. Thus, energy used to heat the workpiece is more efficiently utilized. The thickness of ceramic material will result in an operating external tool temperature of approximately 200° F. which is considerably safer than the 900° F. temperatures found in prior art systems. The 200° F. shell temperature can be reduced to room temperature by adding water cooling to the metal shells.

The shell is an oblate spheroid which is a shape that has been found to be quite able to withstand high magnitude inner pressures. C-clamps are mounted at the periphery of the shell members and firmly secure the shell members together. The C-clamps, or alternatively a nut and bolt system, may be easily attached and removed by the use of simple hand tools. This enables convenient joinder and separation of the shell members of the apparatus allowing a workpiece to be quickly and easily inserted in the die forming cavity or removed therefrom after completion of the superplastic forming operation. Thus, the two piece shell and clamp structure greatly facilitates and streamlines the superplastic forming operation.

A spring may also be provided at each clamp between the clamp nut and the peripheral portion of the shell members in order to exert a force between the clamp and the shell members tending to keep the shell members joined together. When the gas pressure within the shell exceeds the total force exerted by the springs, the springs will collapse allowing the shell members to separate. Consequently, the spring tension of each spring can be selected so as to ensure that they provide automatic venting of gas presssure when the gas pressure within the shell exceeds a desired maximum value. Thus, the present invention has the added advantage of providing a safety device preventing potentially dangerous gas pressure buildup within the superplastic forming apparatus.

From the foregoing it is apparent that the shell member structure and the clamp devices provide a superplastic forming apparatus which is essentially a safe, stand alone device. There is no expensive, complex or bulky press required to keep the die members together to contain forces of compressed gas therein. Thus, the system of the present invention obviates the need for a large and complex superplastic forming device thereby making superplastic forming faster and cheaper and more adaptable to mass production processes.

DETAILED DESCRIPTION OF THE PREFERRED EMBODIMENT

Figure 1:
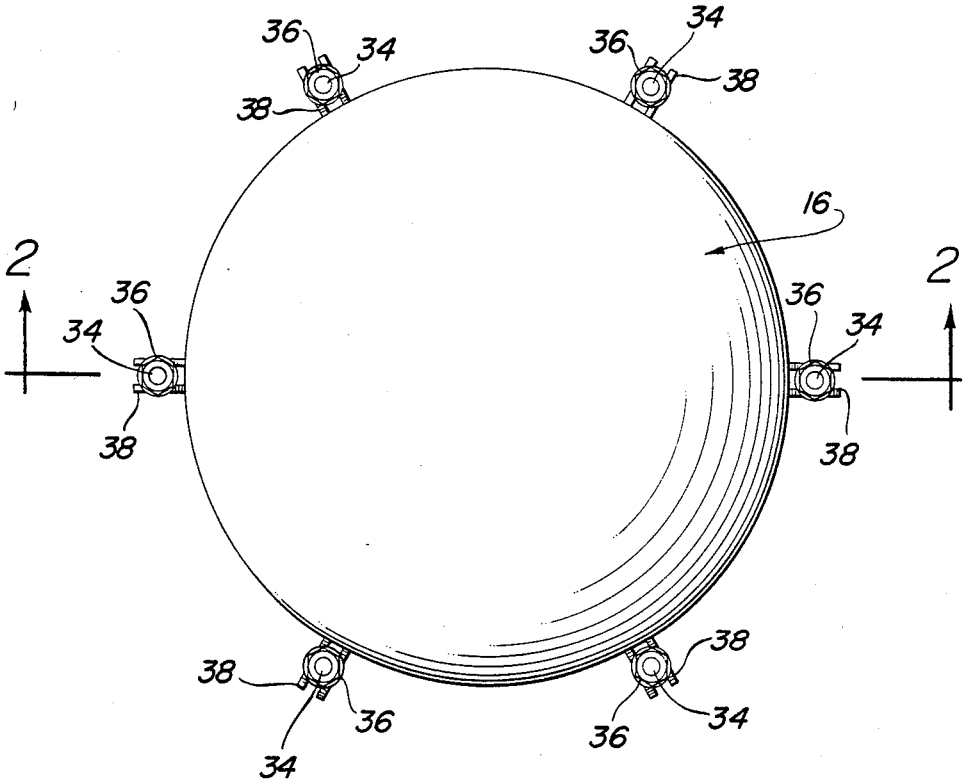
FIG. 1 is a top view of the upper shell of the tooling system of the present invention.
Figure 2:
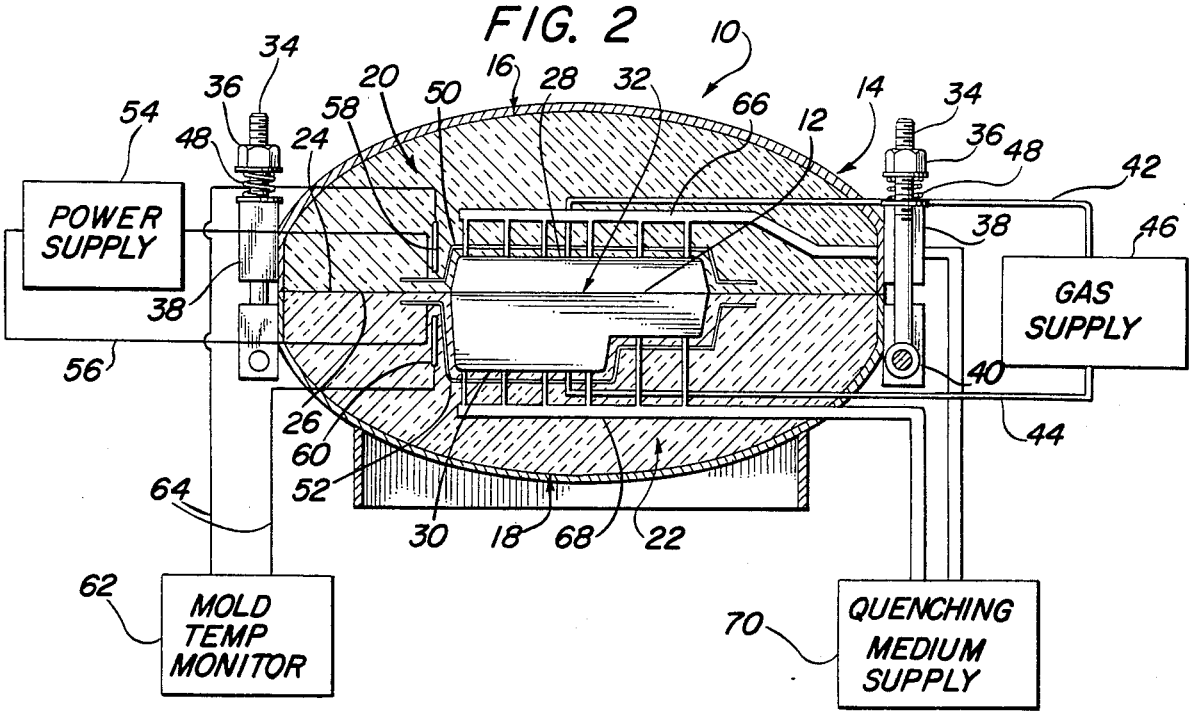
FIG. 2 is a crosssectional side view of the tooling system showing the gas tubes and quenching tubes connected to the component parts of the system and the heating elements mounted within the die members.
Figure 3:
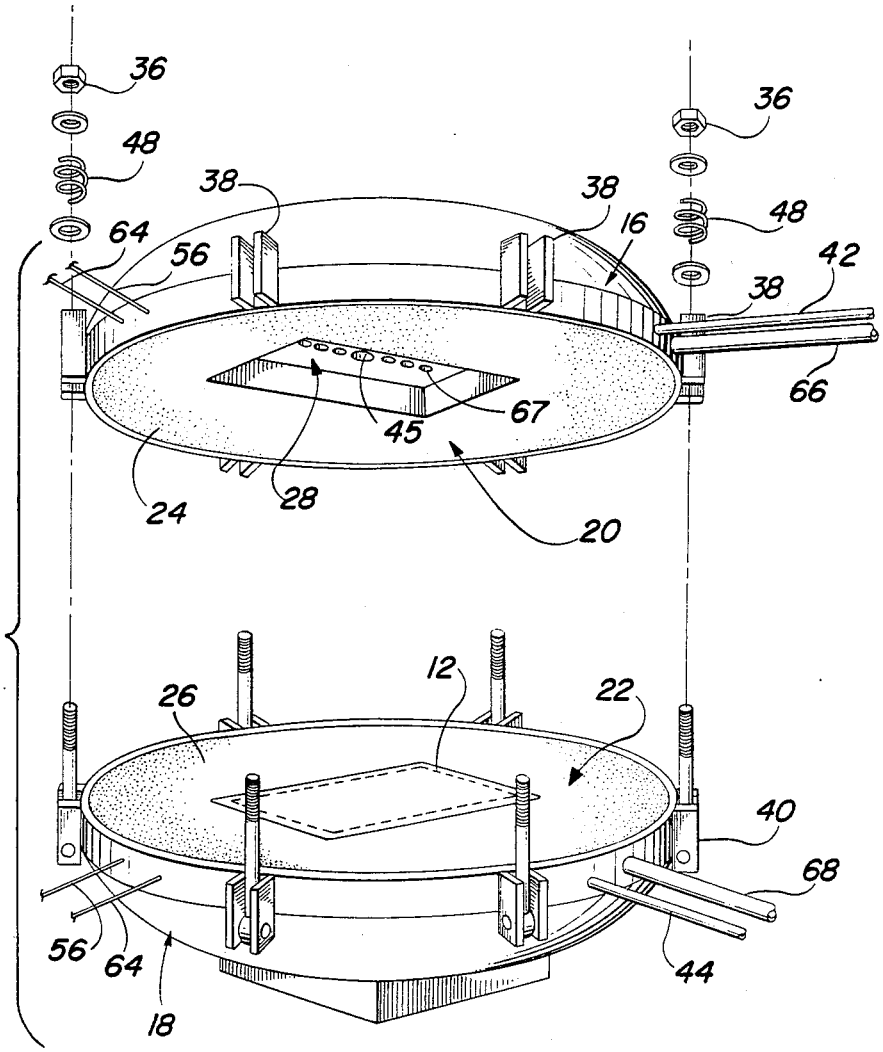
FIG. 3 is a perspective view of the system showing the shell members separated and illustrating the mating surfaces and the cavity surface of one die member.

Referring now to the drawings, FIGS. 1, 2 and 3 show the tooling system of the present invention.

The tooling system of the present invention is generally designated by the numeral 1u. The workpiece, which is to be superplastically formed using the tooling system of the present invention 1u is generally designated by the numeral 12.

Referring to FIG. 2, the tooling system 10 has a shell 14 which comprises an upper shell member or subshell 16 and lower shell member or subshell 18. The upper shell member contains an upper die member 20. Lower shell member 18 similarly contains a lower die member 22. Die members 20 and 22 are preferably secured or bonded to their respective shell members 16 or 18. Upper die member 20 and lower die member 22 are preferably in the form of die halves. Upper die member 20 has a surface or face 24 which is mateable with surface or face 26 of lower die member 22. Upper die member 20 also has another surface 28 defining a recess (not designated) in die member 20. Surface 28 may instead be merely a portion of surface 24. Similarly, lower die member 22 has a surface 30 defining a recess (not designated) therein. Surface 30 may similarly be a portion of surface 26. When shell members 16 and 18 and die members 20 and 22 contained therein are joined together, surfaces 24 and 26 are in contact with or proximal to each other and surfaces 28 and 30 define a die cavity 32.

Die members 20 and 22 are preferably composed of liquid hardenable ceramic capable of withstanding the high temperatures and high compressive pressures used in superplastic forming. The ceramic is also preferably a good thermal insulator. In addition, metal lining may also be used over the surfaces 28 and 30 defining the cavity 32 in order to strengthen the cavity surfaces 28 and 30 preventing flaking or deterioration of surfaces 28 and 30 after repeated use.

Shell members 16 and 18 as well as die members 20 and 22 are held together by means of nut 34 and bolt 36 mounted on peripheral portions of shell members 16 and 18. Preferably, there are mounting brackets 38 and 40 at the peripheral portions of shell members 16 and 18. Instead of a nut and bolt arrangement at the brackets 38 and 40, C-type clamps or other appropriate types of fasteners may be used. Tubes 42 and 44 connect the gas supply 46 to the cavity at outlets 45. Gas supply 46 feeds gas or other appropriate fluid under high pressure through tubes 42 and 44 into the cavity at outlet 45 in order to superplastically form the workpiece 12 therein. As a safety precaution, springs 48 are provided at each clamping means to vent gas or fluid from the cavity in the event of excess gas or fluid pressure buildup therein. These springs 48 are mounted between the nuts 36 and upper shell member bracket 38. The springs 48 thereby exert a force tending to close the shell members 16 and 18 together. This spring force or tension can be selected so that the total force exerted by springs 48 equals the maximum desired gas pressure in the cavity 32. Thus, when the gas pressure which tends to push the shell members 16 and 18 apart exerts a total force which exceeds the countervailing force exerted by the springs 48 the shell members 16 and 18 and die members 20 and 22 separate allowing excess gas to vent from the cavity 32. The gas is vented in small quantities and velocities which present minimal hazard to personnel and equipment.

It is to be noted that at least one of the die cavity surfaces 28 and 30 is functionally a die surface. In addition, one of the recesses formed by surfaces 28 and 30 is provided in order to allow pre-stretching of the workpiece 12 or to accommodate an irregularly shaped workpiece 12. However, the pre-stretching recess may be eliminated if the workpiece 12 is not irregularly shaped or does not require pre-stretching. Sealing of the die cavity 32 may be provided by an appropriately shaped and positioned peripheral portion (not designated) of the workpiece 12. The border or peripheral portion (not designated) of the workpiece 12 is squeezed together by means of mating surfaces 24 and 26 and springs 48. Thus, the workpiece 12 can provide sealing of the cavity 32 thereby preventing pressurized gas from escaping out of the cavity 32.

Heating elements 50 and 52 are provided to heat the workpiece 12 and the cavity 32. Heating elements 50 and 52 are preferably embedded in both die members 20 and 22 and are preferably one quarter to one eighth inch from surfaces 28 and 30 or as close to surfaces 28 and 30 as practical without excessively weakening the ceramic surface. The ceramic material of die members 20 and 22 is a good heat insulator. Consequently, the heat produced by heating elements 50 and 52 is not dispersed and dissipated throughout the die members 20 and 22, but, rather, tends to concentrate in the immediate area of the heating elements 50 and 52. Consequently, approximate positioning of the heating elements proximal to surfaces 28 and 30 allows a substantial amount of the heat produced by the heating elements to be transmitted to die cavity surfaces 28 and 30 and to the workpiece within the cavity. Thus, the heat provided to the workpiece 12 by the heating elements 50 and 52 is energy efficient compared to other metallic die systems. A power supply 54, preferably electrical, is connected to heating elements 50 and 52 by means of electrical wires or connections 56. Alternatively, die members 20 and 22 could be provided with ducts (not shown) instead of heating elements 50 and 52 for insertion of heating elements therein or for heating fluid to pass therethrough and thereby heat the cavity surfaces 28 and 30. The ducts can be formed by positioning tubing in the die members prior to hardening of the ceramic and burning out or otherwise elmininating the tubing after the ceramic hardens. Sensors 58 and 60 are positioned in contact with or proximal to heating elements 50 and 52 in order to sense the temperature of the heating elements 50 and 52 and/or the temperature of surface 28 and/or surface 30. Sensors 58 and 60 are connected to mold temperature monitor 62 by means of connections 64. The temperature of the heating elements 52 and 50 and/or surfaces 28 and 30 is thereby monitored and the temperature of the mold or die cavity is ascertained. Electrical power supplied to heating elements 50 and 52 can accordingly be altered in order to control the temperature of the mold or die cavity 32.

Quenching fluid conduits or tubes 66 and 68 connect quenching medium supply 70 to the die cavity 32. After the workpiece 12 has been superplastically formed into its desired shape and thickness, a suitable quenching fluid is expelled into the die cavity 32 and onto the workpiece 12 in order to cool the workpiece. After the workpiece 12 has cooled sufficiently that it is not tightly in contact with the die surface, fasteners 35 are removed, shell members 16 and 18 and die members 20 and 22 are separated and the workpiece 12 may be removed from cavity 32.

Accordingly, there has been provided, in accordance with the invention, a tooling system for superplastic forming of a workpiece capable of being superplastically formed that fully satisfies the objectives set forth above. It is to be understood that all terms used herein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include all such alternatives, embodiments, modifications and variations that fall within the spirit and the scope of the invention as set forth in the claims herein and below.

I claim:

1. A tooling system for superplastic forming of a workpiece, comprising:

a shell, said shell comprising an upper subshell and a lower subshell;

an upper die member disposed within said upper subshell, said upper die member composed of liquid hardenable material;

a lower die member disposed within said lower subshell, said lower member composed of liquid hardenable material, said upper member having a surface exposed from said upper subshell and said lower member having a surface exposed from said lower subshell, said upper member surface and said lower member surface defining a die cavity when said upper member and said lower member are joined together;

means for releasably securing said upper subshell and said lower subshell together; p1 means for heating the die cavity;

a source of pressurized gas;

a gas conduit, said gas conduit connecting said source of gas to the cavity for providing pressurized gas to the workpiece in the cavity in order to superplastically form the workpiece;

a resiliant venting means associated with said securing means for relieving excessive gas pressure within the cavity.

2. The system of claim 1 wherein said venting means includes springs mounted on said shell, said springs exerting a force tending to close said upper and said lower subshells together, said springs having a tension allowing gas pressure in the cavity to automatically separate said upper subshell from said lower subshell when the gas pressure in the cavity exceeds a desired value.

3. The system of claim 1 wherein said liquid hardenable material is ceramic.

4. The system of claim 1 further including a thermocouple connected to said means for heating.

5. The system of claim 1 wherein said means for heating comprises an upper heating element within said upper member and a lower heating element within said lower member.

6. The system of claim 5 wherein said upper heating element and said lower heating element are spaced between one eighth and one quarter of an inch from the cavity.

7. The system of claim 1 wherein said shell has an oblate spheroid shape when said upper subshell and said lower subshell are secured together.

8. The system of claim 1 wherein said means for releasably securing is at least one fastener.

9. The system of claim 8 wherein at least one fastener comprises a plurality of fasteners positioned at junctures of said upper subshell and said lower subshell.

10. A tooling system for superplastic forming of a workpiece capable of superplastic deformation, comprising:

a die, said die comprising an upper die member and a lower die member, said upper die member having a surface which is mateable with a surface of said lower die member so that said upper die member can be joined to said lower die member, said upper die member having a surface portion and said lower die member having a surface portion, said portion of said upper member in conjunction with said portion of said lower member defining a die cavity for superplastic forming of a workpiece therein:

a shell, said shell comprising an upper shell member partially enclosing said upper die member and a lower shell member partially enclosing said lower die member;

a heating element, said heating element embedded in said die for heating the workpiece;

an electrical power supply connected to said heating element;

a supply of pressurized gas;

a gas tube connecting said supply of gas to the cavity, said gas tube mounted within said die member;

a plurality of clamps for securing said upper and said lower shells members together at their peripheral edges in order to enclose said die;

a supply of quenching fluid;

means for providing fluid from said supply of fluid to the cavity in order to quench the workpiece formed therein;

at least one spring mounted between an end of at least one of said plurality of clamps and peripheral portions of said upper and said lower subshells, said at least one spring having a tension strength allowing said upper shell to separate from said lower shell when the gas pressure in the cavity exceeds a desired value in order to release gas under pressure therefrom to provide automatic venting of excessive gas pressure within the cavity.

11. The system of claim 10 wherein said shell has an oblate spheroid shape when said upper shell member and said lower shell member are joined together.

12. The system of claim 10 wherein the workpiece has a border for sealing the cavity in order to prevent gas from escaping therefrom.

13. The system of claim 10 wherein said heating element is spaced between one eighth of an inch and one quarter of an inch from the cavity.

14. The system of claim 10 further including a thermo-couple connected to said heating element for monitoring the temperature thereof.

15. The system of claim 10 wherein said upper die member is composed of liquid hardenable ceramic material.

16. The system of claim 15 wherein said liquid hardenable material has high compressive strength and low thermal conductivity relative to the workpiece.

17. The system of claim 10 wherein said lower die member is composed of liquid hardenable ceramic material.

18. The system of claim 17 wherein said liquid hardenable material has high compressive strength and low thermal conductivity relative to the workpiece.

19. A tooling system for superplastic forming of a metal workpiece comprising:

an upper die member, said upper die member composed of liquid hardenable ceramic material;

a lower die member, said lower die member composed of liquid hardenable ceramic material, said upper die member having a face and said lower die member having a face, said members being joinable at said faces, said upper die member face having a recessed portion and said lower die member face having a recessed portion, said upper face portion and said lower face portion defining a cavity therebetween for superplastic forming of the workpiece, at least one of said portions of said upper and said lower die member faces having a die surface;

an upper shell member, said upper shell member containing said upper die member, said upper shell member having a peripheral portion;

a lower shell member, said lower shell member containing said lower die member, said lower shell member having a peripheral portion mateable with said peripheral portion of said upper die member so that said upper shell member may be joined to said lower shell member at said peripheral portions of said upper member and at said peripheral portion of said lower member in order that said upper shell member and said lower shell member form an oblate spheroid shell;

a clamp mounted at said peripheral portion of said upper shell member and at said peripheral portion of said lower shell member for releasably securing said upper shell member and said lower shell member together in order to contain gas under pressure therein, said clamp being spring loaded for automatic venting of excessive gas pressure from the cavity.

an upper heating element mounted within said upper die member, said upper heating element positioned between one eighth of an inch and one quarter of an inch from the cavity;

a lower heating element mounted within said lower die member, said lower heating element positioned between one eighth of an inch and one quarter of an inch from the cavity;

a pressurized gas supply;

a gas conduit connecting said gas supply to at least one of said portions of said upper and lower die member faces for providing gas under pressure to the cavity;

a quenching fluid supply;

a quenching fluid conduit connecting said quenching fluid supply to at least one of said portions of said upper and said lower die member faces for providing quenching fluid to the workpiece in the cavity;

a thermo-couple connected to said upper heating element and said lower heating elements for monitoring the temperature of said upper and said lower heating elements;

an electrical power supply connected to said upper heating element and said lower heating element for supplying electrical power thereto.

20. The system of claim 19 wherein said liquid hardenable material in said upper die member is liquid hardened with an upper duct for receiving said upper heating element and said liquid hardenable material in said lower die member is liquid hardened with a lower duct for receiving said lower heating element.

* * * * *